US007077883B2

(12) United States Patent
Kamphuis et al.

(10) Patent No.: US 7,077,883 B2
(45) Date of Patent: Jul. 18, 2006

(54) PRE-ALLOYED BOND POWDERS

(75) Inventors: Bert-Jan Kamphuis, Vosselaar (BE); Janneck Peersman, Herent (BE)

(73) Assignee: Umicore, Brussels (BE)

( * ) Notice: Subject to any disclaimer, the term of this patent is extended or adjusted under 35 U.S.C. 154(b) by 0 days.

(21) Appl. No.: 10/952,428

(22) Filed: Sep. 28, 2004

(65) Prior Publication Data

US 2005/0106057 A1 May 19, 2005

Related U.S. Application Data

(63) Continuation of application No. PCT/EP03/02587, filed on Mar. 7, 2003.

(60) Provisional application No. 60/386,724, filed on Jun. 10, 2002.

(30) Foreign Application Priority Data

Mar. 29, 2002 (EP) ..... 02076257
Sep. 3, 2002 (EP) ..... 02078637

(51) Int. Cl.
*B22F 1/00* (2006.01)
*B22F 3/14* (2006.01)
*C22C 26/00* (2006.01)

(52) U.S. Cl. ..... 75/252; 75/351; 419/11; 419/48

(58) Field of Classification Search ..... 75/252, 75/243, 245, 351; 419/10, 23, 48, 11, 18
See application file for complete search history.

(56) References Cited

U.S. PATENT DOCUMENTS 2,238,351 A * 4/1941 Van der Pyl ..... 428/564
2,410,512 A * 11/1946 Lindqvist et al. ..... 76/101.1
2,828,197 A * 3/1958 Blackmer, Jr. ..... 428/568
3,372,010 A * 3/1968 Parsons ..... 75/237
3,591,362 A 7/1971 Benjamin
6,554,885 B1 * 4/2003 Mende et al. ..... 75/365
6,613,122 B1 * 9/2003 Bonneau et al. ..... 75/255

FOREIGN PATENT DOCUMENTS

| | | |
|---|---|---|
| EP | 0990056 | 3/2002 |
| EP | 0865511 | 3/2003 |
| SU | 1689053 | 11/1991 |
| WO | WO-97/21844 | 6/1997 |
| WO | WO-98/49361 | 11/1998 |

OTHER PUBLICATIONS

JP408229825 A, Abstract. Pub. Sep. 10, 1996.*
JP358217271 A, Abstract. Pub. Dec. 17, 1983.*
SU452489 A, Abstract. Pub. Jan. 23, 1976.*
del Villar et al., "Consolidation of diamond tools using Cu-Co-Fe based alloys as metallic binders", Powder Metallurgy, Metals Society, London, GB, vol. 44, No. 1, 2001, pp. 82-90.
ASM Handbook, vol. 3, Allow Phase diagrams published by ASM International, Materials Park, Ohio, USA, 1992, p. 2.168, p. 2.178 and p. 2.203.

* cited by examiner

*Primary Examiner*—Ngoclan T. Mai
(74) *Attorney, Agent, or Firm*—Hutchison Law Group PLLC

(57) ABSTRACT

The present invention relates to a pre-alloyed powder and its use as a bond powder in the manufacture of powder metallurgy parts and of diamond tools in particular. A pre-alloyed powder is disclosed, based on the iron-copper dual phase system, additionally containing Co, Ni, Mo, W, oxides or carbides as reinforcing elements in the iron phase, and Sn in the copper phase.

13 Claims, 1 Drawing Sheet

Figure 1: Vickers hardness versus Co/Fe ratio for powders prepared according to the invention , with 5 % Mo (◆) or 5 % W (●), and according to prior art (■)
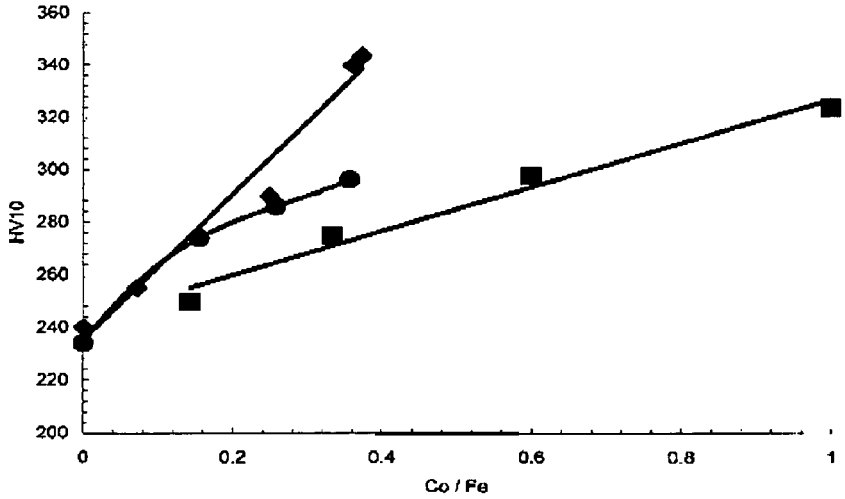

PRE-ALLOYED BOND POWDERS

This application is a continuation of International Application Number PCT/EP03/02587, filed Mar. 7, 2003, which claims the benefit of U.S. Provisional Application No. 60/386,724, filed Jun. 10, 2002, and which also claims priority to European Application Nos. 02076257.1 and 02078637.2, filed on Mar. 29, 2002 and Sep. 3, 2002, respectively; the entire contents of these applications are hereby incorporated herein by reference.

Various methods exist to manufacture diamond tools. In each case the diamond is first mixed with the bond powder, consisting of one or more metallic powders and possibly some ceramic powders or an organic binder. This mixture is then compacted and heated to form a solid piece, in which the bond powder forms the bond that keeps the diamonds together. Hot pressing and free sintering are the most common methods of forming a bond. Other methods are less commonly used, such as hot coining and hot isostatic pressing of pre-sintered parts. Cold compacted powders, which require a subsequent heating step to from the bond, are often called green parts and are characterised by their green strength.

The most frequently used metallic powders in diamond tool applications are fine cobalt powders with a diameter of less than about 7 μm as measured with the Fisher Sub Sieve Sizer (FSSS), mixtures of fine metallic powders such as mixtures of fine cobalt, nickel, iron and tungsten powders, and fine pre-alloyed powders consisting of cobalt, copper, iron and nickel.

The use of fine cobalt powder gives good results from a technical point of view; its major drawbacks stem from the high price and strong price fluctuations. Moreover, cobalt is suspected to damage the environment so that new regulations stimulate the avoidance of cobalt. Using mixtures of fine metallic powders, bonds are obtained whose strength, hardness and wear resistance are relatively low. As the homogeneity of the mixture has a substantial influence on the mechanical properties of the final tool, the use of pre-alloyed powders offers a distinct advantage over mixtures of elemental powders, as documented in EP-A-0865511 and EP-A-0990056. These bond powders are traditionally made by hydrometallurgical means as described in the abovementioned patents. The reason for this is that this is the only economic way to obtain particles that are fine enough, so that they have enough sintering reactivity, while allowing a correct composition to be made so that the properties of the sintered piece, in particular its hardness, ductility, wear resistance and diamond retention, are sufficient.

However, in the diamond tool industry, there is a need for bonds showing better properties than obtained when using state-of-the-art pre-alloyed powders or mixtures of fine metallic powders. Better properties of the bond means a combination of a higher hardness and sufficient ductility. An indicator for the ductility is the impact resistance. This is measured following the Charpy method, according to ISO 5754, on Charpy equipment as described in ISO 184, and should preferably reach a minimum value of 20 J/cm$^2$ on unnotched samples. Lower Charpy values are indicative for a brittle bond. Another indicator of ductility is the fracture surface of a broken bond. This should preferentially reveal (micro-) ductility.

Hardness will be expressed in Vickers hardness (HV10). When hardness values are given, it is assumed that they are measured according to ASTM E92-82. It can be considered as a rule of thumb that a higher hardness in general corresponds to a higher mechanical strength, higher wear resistance and a better diamond retention. HV10 values of 200 to 350 are common in this field.

An increased wear resistance is required to cut abrasive material like fresh concrete or asphalt. State of the art technology makes use of additions of tungsten carbide and/or tungsten. These materials are mixed together with the rest of the bond powders. The homogeneity of the resulting mixture is crucial to the performance of the tool. Zones rich in tungsten and/or tungsten carbide are typically very brittle. Moreover, because tungsten and tungsten carbide are difficult to sinter, their use will give rise to local porosity and hence locally weakened mechanical properties of the bond.

Besides the properties of the bond, described in the previous paragraphs, the properties of the bond powder are also of importance.

Depending upon the application, the bond powder may need to have good sinterability and green strength.

The green strength is measured with the Rattler test. Green parts of 10 mm height and 10 mm diameter, pressed at 350 MPa, are put in a rotating cylinder (length 92 mm and diameter 95 mm) made of fine wire netting of 1 mm$^2$. After 1200 rotations in 12 minutes, the relative weight loss is determined. This results will be referred to hereafter as 'Rattler values'. A lower Rattler value indicates a higher green strength. In applications where the green strength is important, a Rattler value of less than 20% is considered satisfactory, whilst a value of less than 10% is considered as excellent.

In powder metallurgy, it is important that metal powders exhibit a good sintering reactivity. This means that they can be sintered to nearly full density at a relatively low temperature, or that only a short time is needed to sinter pieces to full density. The minimum temperature required for good sintering should be low, preferably not higher than 850° C. Higher sintering temperatures lead to disadvantages like reduced life of the sintering mould, diamond degradation and high energy cost. A good indicator of sinterability is the relative density obtained. The relative density of a sintered bond powder should be at least 96%, preferably 97% or higher. Typically a relative density of 96% or more is considered nearly full density.

The sintering reactivity depends strongly on the composition of the powder. However, often there is not much choice as far as the composition is concerned, because of cost reasons, or because certain properties of the sintered product, such as hardness, cannot be achieved if the composition is changed. Another factor that influences the sintering reactivity is surface oxidation. Most metal powders will oxidise to a certain extent when they are exposed to air. The surface oxide layer that is formed this way, inhibits sintering. A third factor which is very important for sintering reactivity, is the particle size. All else being equal, finer powders have a higher sintering reactivity than courser powders.

To improve the sinterability of a bond powder, bronze (Cu—Sn alloy) or brass (Cu—Zn alloy) are sometimes added: they lower the melting point and, hence, the sintering temperature. The bronze powder typically used has a composition ranging from 15 to 40% of Sn. Use of these powders however often results in brittle bonds or in the formation of a liquid phase during sintering, both of which are detrimental to the quality of the finished bond. Moreover, the addition of bronze or brass powder softens the bond and thus partly annihilates the effect of the addition of W or WC.

State-of-the-art diamond tool technology has no real solution for the issue of increasing hardness whilst maintaining a low sintering temperature, easy processing, a sufficiently high impact resistance and sufficient green strength. There exists no powder or mixture of powders in the prior art that has all these properties.

A pre-alloyed powder is defined as "A metallic powder composed of two or more elements that are alloyed in the powder manufacturing process and in which the particles are of the same nominal composition throughout". See Metals Handbook, Desk Edition, ASM, Metals Park, Ohio, 1985 or Metals Handbook, vol. 7, Powder Metallurgy, ASM, Ohio, 1984.

The object of the present invention is to provide pre-alloyed metal powders which have sufficient strength for normal manipulation when cold pressed and which sinter at a minimum temperature not over 850° C. and which, when sintered, result in bonds showing sufficient ductility and increased hardness. They contain no or much less Co and/or Ni than existing pre-alloyed metal powders with comparable hardness. This makes them potentially cheaper and preferable from an environmental point of view. Alternatively, the present invention can be seen as providing pre-alloyed metal powders which result in bonds having a higher hardness than bonds produced from existing pre-alloyed metal powders having the same amount of Co and/or Ni. The metal powders of the present invention have, besides their use in the diamond tool industry, also a strong potential in other applications since they are amongst the rare powders that combine hardness with ductility.

Another object of the present invention is linked to the price of bond powders: even though a variety of hydrometallurgical methods produce suitable bond powders at an acceptable cost, the price of these bond powders is still much higher than that of pure or alloyed metal powders that are coarser, typically in the range of 20–100 microns, and that are produced by non-hydrometalurgical methods, such as atomisation. However, these coarse powders do in general not possess the sintering properties needed to make them suitable for diamond tools.

A well known method of making pre-alloyed powders is mechanical alloying. In this method, elemental powders are coarsely mixed, and then mechanically alloyed in a suitable machine, usually similar to a high intensity ball mill. It relies on repeated breakage and cold welding of initially unmixed metallic materials which by this method become mixed on an atomic scale. This method has been known since a long time, see e.g.: U.S. Pat. No. 3,591,362.

Metallic powders made by mechanical alloying possess a much higher sintering reactivity than alloyed powders made by different methods, such as atomisation, or the hydrometallurgical methods described in the prior art. This was found to be true as well for elemental metal powders, or alloyed powder made by methods such as atomisation, when they underwent a similar treatment as would be needed to mechanical alloy a mixture of elemental powders. Even if the powders according to the prior art were much finer, and would thus have been expected to have a higher sintering reactivity, a direct comparison showed the reverse: the mechanically treated powders possess a much higher sintering reactivity.

The pre-alloyed powders according to the invention contain Cu and Fe as the two base alloying elements. Fe and Cu are not mutually soluble. The powder particles will therefore contain two phases, one being rich in Fe, the other being rich in Cu. To ensure a low enough sintering temperature, Sn is added to the Cu rich phase. Sn will lower the melting point and, hence, also the sintering temperature. To increase the strength of the alloy and to guarantee a ductile alloy at levels of Sn close to the peritectic composition of the binary alloy Cu—Sn, the Fe rich phase is reinforced by at least one of Mo, Ni, Co and W. Additionally, dispersion strengtheners (DS) may be added in the form of oxides (ODS), carbides (CDS), or as a combination of both. Useful oxides are oxides of metals that cannot be reduced by hydrogen below 1000° C., like Mg, Mn, Ca, Cr, Al, Th, Y, Na, Ti and V. Useful carbides are carbides of Ti, Zr, Fe, Mo and W.

The powders according to the invention have the formula $$Fe_aCo_bNi_cMo_dW_eCu_fSn_g(DS)_h,$$

and obey the following compositional constraints:

- The sum of the weight percentages a, b, c, d, e, f, g and h of the constituents of the alloy equals 100%, the term 'constituents' denoting those elements intentionally present in the alloy, thus excluding impurities and oxygen, except if the oxygen is part of an ODS. Thus: $a+b+c+d+e+f+g+h=100$.
- Mo should not exceed 8% and W 10%, to prevent excessive brittleness. Thus: $d \leqq 8$ and $e \leqq 10$. Preferably $c \leqq 30$.
- The dispersion strengtheners should not exceed 2% in order to guarantee sufficient homogeneity of the sintered powders. Thus $h \leqq 2$. Preferably $h \leqq 1$ and more preferably $h \leqq 0.5$.
- The sum of Sn and Cu should be at least 5% but not more than 45%. The lower limit guarantees an adequate sinterability, the upper limit guarantees that the bonds are not too soft. Thus: $5 \leqq f+g \leqq 45$. Preferably $7 \leqq f+g \leqq 40$ and more preferably $11 \leqq f+g \leqq 32$.
- The Cu/Sn ratio should lie between 6.4 and 25. The lower limit guarantees that formation of brittle phases in the Cu regions is avoided, the upper limit guarantees a sufficient activity of Sn as a sintering temperature reducing element. Thus: $6.4 \leqq f/g \leqq 25$. Preferably $8.7 \leqq f/g \leqq 20$ and more preferably $10 \leqq f/g \leqq 13.3$.
- The composition of the powder obeys the following compositional constraints:

$$1.5 \leqq [a/(b+c+2d+2e)]-4h \leqq 33 \quad (1).$$

Alternatively, the following equations are to be obeyed:

$$1.5 \leqq a/(b+c+2d+2e+50h) \leqq 33 \quad (2),$$

and $$b+c+2d+2e \geqq 2.$$

- The lower limit in above equations (1) and (2) guarantees that homogeneity of the sintered powder and pricing of the powder is acceptable; the upper limit guarantees that the sintered powders are sufficiently hard. The preferred lower limit is 1.6, more preferably 2 and most preferably 2.5. The preferred upper limit is 17 and more preferably 10.
- For the pre-alloyed powders to effectively address the drawbacks of the state-of-the-art technology and make superior bonds, they should have an oxygen content, as measured by the method of loss in hydrogen ISO 4491-2:1989, not exceeding 2%, preferably not exceeding 1% and more preferably not exceeding 0.5%. This method does not measure the oxygen chemically bound to an intentionally added ODS. The oxygen content needs to be small because the presence of oxygen is detrimental to the sintering reactivity of the powder and to the ductility of the sintered bond.

In one embodiment this invention allows suitable bond powders for diamond tools to be made more economically, by taking cheap atomised powders and activating them by mechanical alloying.

In another embodiment of the invention the particle size of the powder as expressed by their FSSS value, does not exceed 20 μm, preferably does not exceed 15 μm and more preferably does not exceed 10 μm. This guarantees a good compromise between low sintering temperature and short reduction time for the precursors used in the manufacturing process of the powders.

The concentrations of Co and Ni are preferably kept low, because these elements are under strong suspicion of damaging the environment. Powder containing neither Co nor Ni are specially advantageous from an ecological point of view. The concentrations of Mo and W are also preferably not too high, because alloys with high Mo or W levels are susceptible to the precipitation of the W or Mo at the grain boundaries of the Fe rich phase, which makes the bond less ductile.

The pre-alloyed powders of the present invention are characterised by the fact that they are highly porous. This has the advantage that the specific surface area, as measured by the BET method mentioned before, is much higher than would be the case for solid particles, such as atomised particles. In general it can be said that for metallic powders of the same composition, a higher specific surface area is indicative for a higher sintering reactivity. In general the pre-alloyed powders of the present invention have a specific surface area that is at least twice as high as the specific surface area calculated on the basis of the FSSS diameter assuming a solid sphere geometry. The specific surface of the powder, as expressed by its BET value, is preferably higher than 0.1 $m^2/g$.

The interactions of Cu, Sn and Fe are now explained as understood by the inventors. The presence of Cu in the pre-alloyed powder tends to soften the bond. This effect can be compensated by an appropriate Sn addition. This also has the effect of helping to reduce the sintering temperature needed to sinter the pre-alloyed powder. From the binary Cu—Sn phase diagram one can see that for Sn levels exceeding 13.5% but lower than 25.5%, a peritectic reaction takes place at 798° C. Below that temperature, a dual phase structure will exist, consisting of the α and β phase. Upon further cooling, the β phase will transform into the brittle δ phase and thus strongly decrease the alloy's ductility. Decreasing the Sn-level reduces the risk of introducing the brittle δ phase, but it also makes the alloy move up the solidus line. The solidus line is relatively steep. Therefore, to have the full sintering temperature reducing effect of Sn whilst avoiding the negative consequences of brittle δ phase formation, one should make sure to be as close as possible to, but not beyond, the peritectic composition of the binary alloy.

When the pre-alloyed metal powder also contains Fe, such as in the case of this invention, the binary phase diagrams Cu—Fe and Fe—Sn have to be consulted. Alloy phase diagrams of Cu—Sn, Fe—Sn and Cu—Fe are available from a multitude of sources. One such source is the ASM Handbook, Vol. 3, Alloy phase diagrams published by ASM International, Materials Park, Ohio, USA, 1992, p. 2.168 for Cu—Fe, p. 2.178 for Cu—Sn, p. 2.203 for Fe—Sn. From the Fe—Sn diagram, it follows that the equilibrium solubility of Sn in Fe at 700° C. is about 10%. From the Cu—Fe diagram, it can be derived that the equilibrium solubility of Cu in the Fe-phase at 700° C. is much lower: less than 0.3%. In a ternary system, these solubility limits will be somewhat, but not significantly, different.

Given the immiscibility of Cu and Fe, it follows that Sn at 700° C. or higher will always dissolve more readily in the Fe-lattice than does Cu. In a ternary Cu—Fe—Sn alloy, the Cu-rich phase will therefore be depleted of Sn during the sintering step. From the binary Cu—Sn phase diagram, it thus follows that the melting point will increase. To fully benefit from the melting point reducing effect of Sn, which is the objective of Sn addition, the alloy should therefore have a Sn/Cu ratio that is higher than the peritectic ratio of 13.5/86.5 or 1/6.4. However, as explained above, this will lead to formation of the brittle δphase which is undesirable.

Upon cooling the bond, most of the Sn will diffuse back into the Cu-rich phase since the solubility of Sn in Fe at room temperature is negligible. This will cause local enrichment of Sn in Cu near the grain boundaries, making the occurrence of brittle δ phase formation even more likely. The same back-diffusion of Sn into the Cu phase can also cause the critical Sn/Cu ratio of 1/6.4 to be locally exceeded even in materials that have an overall Sn/Cu ratio below 1/6.4. It is therefore extremely difficult to design an alloy in the Cu—Fe—Sn system that takes full advantage of the melting point reducing and Cu-reinforcing effects of Sn, whilst avoiding the formation of the δ phase.

The addition of one of the reinforcing elements Mo, W, Ni or Co however influences the mechanism explained above in a most interesting way: by strengthening the Fe-rich phase through solid solution strengthening, these reinforcing elements effectively block the Fe-lattice for Sn atoms diffusing into it. The Sn remains therefore in the Cu phase during heating of the bond powder: The positive effects of Sn on the sintering behaviour can therefore be fully taken advantage of. It is precisely this combined effect of Sn in a well-determined Cu/Sn ratio and of reinforcing elements that block the diffusion of Sn into the Fe phase that is at the heart of this invention. It allows to combine the characteristics of sufficient strength and high ductility when the pre-alloyed powder is sintered at a relatively low temperature.

The constituents need to be as finely dispersed as possible. For the oxides/carbides this follows from the fact that, the shorter the mean free path between the oxides/carbides and the smaller the oxides/carbides, the more pronounced their strengthening effect. For the metallic elements this follows from the fact that a homogeneous microstructure improves the mechanical properties. This has been described in EP-A-0865511 and EP-A-0990056, based on experiments in the Co—Fe—Ni and Cu—Co—Fe—Ni systems, where it is also revealed that pre-alloyed powders offer higher strength than a blend of elemental powders. Indeed, for solid solution strengthening to be active, the alloy needs to be as homogeneous as possible. When Mo and W are added to reinforce the Fe-lattice, their homogeneous distribution is of particular importance, as Mo and W exhibit very low diffusion coefficients at the temperatures that are typically applied in diamond tool manufacturing. Suitable synthesis processes are now described.

The powders of the invention may be prepared by heating in a reducing atmosphere a precursor or an intimate mixture of two or more precursors. These precursors are organic or inorganic compounds of the constituents of the alloy. The precursor or intimate mixture of precursors must contain the elements of the constituents, with the exception of C and O, in relative amounts that correspond to the intended composition of the powder. In the production process, a distinction is made between so-called elements in class 1, which are Co, Ni, Fe, Cu, Sn and the elements of the ODS with the exception V, and elements in class 2, which are W, Mo, V and Cr.

The precursors may be prepared by any or a combination of the following methods (a) to (f).

(a) For the elements in class 1: mixing an aqueous solution of a salt of one or more constituents with an aqueous solution of a base, a carbonate, a carboxylic acid, a carboxylate, or a mixtures of these, so that an insoluble or poorly soluble compound is formed. Only those carboxylic acids or corresponding carboxylates are suitable that form an insoluble or poorly soluble compounds with the aqueous solution of the salt of the constituent. Examples of a suitable carboxylic acid and carboxylate are oxalic acid or potassium oxalate. Acetic acid and metal acetates on the other hand are not suitable. The precipitate thus obtained is then separated from the aqueous phase and dried.

(b) For the elements in class 1 and 2: mixing an aqueous solution of a salt or salts of one of the elements in class 2 with an aqueous solution of a salts or salts of one or more of the elements in class 1 so that an insoluble or poorly soluble precursor of the general formula (element of class 1)×(element of class 2)$_y$O$_z$ is formed, in which x, y and z are determined by the valence of the element in solution. An example of such compound is $CoWO_4$. The precipitate thus obtained is then separated from the aqueous phase and dried.

(c) For the elements in class 2: mixing an aqueous solution of a salt or salts of one or more of the elements in class 2 with an acid so that insoluble or poorly soluble compounds with the general formula such as $MoO_3.xH_2O$ or $WO_3.xH_2O$ are formed. The variable x indicates a varying amount of crystal water, normally smaller than 3. The precipitate thus obtained is then separated from the aqueous phase and dried.

(d) For all elements in classes 1 and 2: by mixing, as in a, b and c, a precipitate containing part of the constituents with a suitable dissolved salt of one or more other constituents of the alloy and drying this mixture.

(e) For all elements in classes 1 and 2: by drying a mixed aqueous solution of salts of the constituents of the alloy.

(f) For all elements in classes 1 and 2: by thermal decomposition of any of the products under (a), (b), (c), (d) and (e).

Whenever a drying process is mentioned in the previous section, it must be understood that drying has to be done fast enough so that the various constituents remain mixed during the drying process. Spray drying is a suitable drying method. Not all salts mentioned under (a), (b), (c), (d) and (e) are suitable. Salts that, after undergoing the reduction treatment mentioned below in the first paragraph of this section, leave behind a residue with elements that are not present in the constituents are not suitable. The other salts are suitable.

The aforementioned intimate mixture of two or more precursors may be prepared by making a slurry of these precursors in a suitable liquid, normally water, vigorously stirring this slurry for sufficient time and drying this slurry. The reduction conditions should be such that the constituents, except ODS or CDS, are completely or nearly completely reduced, as indicated by the oxygen content mentioned in the description of the invention, and yet that the FSSS diameter does not exceed 20μ. Typical reduction conditions for the powders of this invention are a temperature of 600 to 730° C. and a duration of 4 to 8 hrs. However, for each powder suitable reduction conditions should be established experimentally, since there is a trade-off between reduction time and reduction temperature, and not all furnaces behave in exactly the same manner. Finding suitable reduction conditions can be done easily by a skilled person by simple experimentation using the following guidelines:

- if the FSSS diameter is too large, the reduction temperature should be reduced;
- if the oxygen content is too high, the duration of the reduction should be increased;
- alternatively the reduction temperature can be increased if the oxygen content is too high, but only if this does not increase the FSSS diameter beyond the boundaries of the invention.

The reducing atmosphere is normally hydrogen, but can also contain other reducing gasses, such as methane or carbon monoxide. Inert gasses such as nitrogen and argon may also be added.

If a CDS is to be formed during reduction, the reaction should be performed in an atmosphere with a sufficient carbon activity.

In conclusion, the pre-alloyed powders that are the subject of this patent are able to deal with all of the aforementioned drawbacks and have the following advantages:

- the powders are made in a chemical process, resulting in porous particles and rough surface morphology and in a high specific surface values, thus positively influencing both cold compactibility and sinterability;
- the addition of Co, Mo, Ni or W, with Mo and W being particularly effective, allows to increase hardness substantially. The ODS and CDS have the same effect;
- the system is situated in a compositional window that offers sufficient impact resistance, the addition of Co, Mo, Ni or W allowing for sufficiently high levels of Sn to have the full effect on sintering temperature, whilst maintaining a sufficiently ductile structure.

The powder can be sintered at relatively low temperatures in a standard sintering process, without requiring complicated process steps.

The production process of the bond powders of the invention and their properties are illustrated in the following examples.

EXAMPLE 1

Preparation of a Fe—Co—Mo—Cu—Sn Alloy

This example relates to the preparation of a powder according to the invention by the precipitation of a mixed hydroxide and the subsequent reduction of this hydroxide.

An aqueous mixed metal chloride solution containing 21.1 g/l of Co, 21.1 g/l of Cu, 56.3 g/l of Fe (this can be $Fe^{2+}$ and/or $Fe^{3+}$) and 1.6 g/l of Sn, is added—while stirring—to an aqueous solution of 45 g/l NaOH until a pH of circa 10 is reached. One hour extra time is allowed for the reaction to finish, during which the pH is monitored and if necessary adjusted with metal chloride solution or NaOH to stay around a value of 10. Under these conditions more than 98% of each of the metals is precipitated.

The absolute values of the concentrations of the metals mentioned are indicative and can vary widely between only a few g/l total metal content and the solubility limit. The ratio of the metal concentrations is dictated by the end product to be obtained. Similarly, the concentration of the NaOH solution can vary between the same limits, but must be sufficient to bring the pH of the mixture to between 7 and 10.5. The final pH is not critical; it can be between a pH of 7 and 10.5, but normally falls in the range of 9 to 10.5.

The precipitate is separated by filtration, washed with purified water until essentially free of Na and Cl, and mixed with an aqueous solution of ammonium hepta molybdate ($(NH_4)_6Mo_7O_{24}.4H_2O$). The concentrations of the precipitate and the ammonium hepta molybdate in this mixture are not critical, as long as the viscosity of the formed slurry is low enough to allow pumping, and the concentration of the precipitate and ammonium hepta molybdate correspond to the ratio of the metals in the intended alloyed metal powder. Instead of ammonium hepta molybdate, ammonium di molybdate ($(NH_4)_2Mo_2O_7$) can also be used. The mixture is dried in a spray drier and the dried precipitate is reduced for 7.5 hr in a furnace at 730° C. in a stream of hydrogen of 200 l/hr.

A porous metallic cake, which after milling yields a powdery metallic product (called hereafter Powder 1) was obtained, consisting of 20% of Co, 20% of Cu, 53.5% of Fe, 5% of Mo, 1.5% of Sn (these percentages are on the metallic fraction only) and 0.48% of oxygen as measured by the method of loss in hydrogen.

Powder 1, $Fe_{53.5}CO_{20}Mo_5Cu_{20}Sn_{1.5}$, is a composition according to the invention. The powder particles have an average diameter of 9.5 μm, measured with the FSSS.

EXAMPLE 2

Preparation of a Fe—Mo—Cu—Sn Alloy

The method of Example 1 was used, but with concentrations of the various metal salts adapted to obtain a different final composition. The reduction temperature in this case was 700° C.

A metallic powder (called hereafter Powder 2) was made consisting of 20% of Cu, 73.5% of Fe, 5% of Mo, 1.5% of Sn (these percentages are on the metallic fraction only) and 0.44% of oxygen. The powder particles have an average diameter of 8.98 μm, measured with the FSSS.

Powder 2, $Fe_{73.5}Mo_5Cu_{20}Sn_{1.5}$, differs from Powder 1 in that all of the Co has been replaced by Fe, Powder 2 thus being free of Co and Ni. This powder falls within the compositional range of the invention.

EXAMPLE 3

Preparation of a Fe—Co—W—Cu—Sn Alloy

This example relates to the preparation of a powder according to the invention by the precipitation of single-metal hydroxides, the subsequent mixing of these in a slurry, followed by drying and by reduction of this mixture of hydroxides.

Individual hydroxides or oxyhydroxides of Co, Cu, Sn and Fe were produced from the individual metal chloride solutions following the precipitation, filtration and washing as described in Example 1. A slurry was made from a mixture of these individual hydroxides. The concentrations of the individual metal hydroxides corresponded to the desired pre-alloyed powder composition. To this slurry, a solution of ammonium meta tungstate ($(NH_4)_6H_2W_{12}O_{40}.3H_2O$) in water was added, in a concentration and amount that corresponded to the final composition of the pre-alloyed powder. Instead of ammonium meta tungstate, ammonium para tungstate ($(NH_4)_{10}H_2W_{12}O_{42}.4H_2O$) can be used as well.

The elements in the slurry were well mixed, spray dried, reduced and milled following Example 1. A metallic powder (called hereafter Powder 3) was obtained consisting of 20% of Co, 20% of Cu, 53.5% of Fe, 1.5% of Sn, 5% of W tin (these percentages are on the metallic fraction only) and 0.29% of oxygen. The powder particles have an average diameter of 4.75 μm, measured with the FSSS.

Powder 3, $Fe_{53.5}CO_{20}W_5Cu_{20}Sn_{1.5}$, falls within the compositional range of the invention; it differs from Powder 1 in that Mo was substituted by W.

EXAMPLE 4

Preparation of a Fe—W—Cu—Sn Alloy with ODS

The method of Example 1 was used with concentrations of the various metal chlorides in the starting solution adapted to obtain a different final composition; Y, in the form of soluble $YCl_3$, was added to the solution. Ammonium meta tungstate was used instead of ammonium hepta molybdate.

A metallic powder (called hereafter Powder 4) was obtained consisting of 20.45% of Cu, 75% of Fe, 1.8% of Sn, 2.5% of W, 0.25% of $Y_2O_3$ (these percentages are on the metallic fraction only) and 0.44% of oxygen. The powder particles have an average diameter of 2.1 μm, measured with the FSSS.

Powder 4, $Fe_{75}W_{2.5}Cu_{20.45}Sn_{1.8}(Y_2O_3)_{0.25}$, falls within the compositional range of the invention and is completely free of Co and Ni.

EXAMPLE 5

Green Strength and Sinterability Tests

This example relates to a series of tests comparing the sinterability of the Powders 1, 2 and 3 to standard bond powders. The following reference powders were also tested.

(a) Extra Fine Cobalt powder (Umicore EF) produced by Umicore, which is considered as the standard powder for the manufacture of diamond tools, was sintered in the same conditions as the pre-alloyed powders. Umicore EF has an average diameter of 1.2 to 1.5 μm as measured with the FSSS. Its oxygen content is between 0.3 and 0.5%. Its Co content is at least 99.85%, excluding oxygen, the balance being unavoidable impurities. The values measured on Umicore EF are mentioned as a reference.

(b) Cobalite® 601 produced by Umicore, refers to a commercially available pre-alloyed powder, consisting of 10% Co, 20% Cu and 70% Fe.

(c) Cobalite® 801 refers to another commercially available pre-alloyed powder from Umicore, consisting of 25% Co, 55% Cu, 13% Fe and 7% Ni. Both Cobalite® powders are produced according to the invention as described in EP-A-0990056.

To assess the green strength, Rattler tests were performed on Powders 1 to 4 and on the reference samples. The results are given in the Table 1.

TABLE 1

Green strength of bond powders

| Powder | Rattler value (%) |
|---|---|
| Umicore EF | <5 |
| Cobalite ® 601 | <5 |
| Cobalite ® 801 | <5 |
| Powder 1 | <5 |
| Powder 2 | <5 |
| Powder 3 | <5 |
| Powder 4 | <5 |

The results show that the green strength of the new powders is as good as that of the reference powders.

A series of tests comparing the sinterability of Powders 1 to 4 with the reference powders were performed as follows: disk-shaped compacts with a diameter of 20 mm were sintered at 35 MPa for 3 minutes at different temperatures in graphite moulds. The relative density of the sintered pieces were measured. The results are given in Table 2.

TABLE 2

Relative density of sintered powders

| Powder | Density (%) at sintering temperature | | | |
|---|---|---|---|---|
| | 750° C. | 800° C. | 850° C. | 900° C. |
| Umicore EF | 95.4 | 97.1 | 97.6 | 97.5 |
| Cobalite ® 601 | 97.9 | 97.3 | 97.8 | 98.3 |
| Cobalite ® 801 | 96.7 | 97.7 | 97.2 | 97.2 |
| Powder 1 | 97.5 | 97.2 | 98.8 | 97.9 |
| Powder 2 | 99.4 | 99.5 | 99.7 | 99.7 |
| Powder 3 | 97.7 | 97.6 | 98.4 | 97.2 |
| Powder 4 | 98.2 | 98.3 | 98.7 | 98.5 |

The results show that densities close to the theoretical density of the alloys can be obtained for the new powders by sintering under pressure. Moreover, high density values are obtained at relatively low temperatures. Sintering above 850° C. does not improve the relative density of Powders 1 to 4.

EXAMPLE 6

Mechanical Properties of the Fe—Co—Ni—Mo—W—Cu—Sn Alloys

This example relates to a series of tests comparing the mechanical properties of the Powders 1 to 4 with the reference powders.

Bar-shaped compacts with dimensions of 55×10×10 $mm^3$ were sintered at 35 MPa for 3 minutes at a temperature of 800° C. in graphite moulds. The Vickers hardness and impact resistance of the sintered pieces were measured (Charpy method). The results of the measurements are given in the Table 3. The values measured on similar segments of Umicore EF, Cobalite® 601 and Cobalite® 801 are mentioned as a reference.

TABLE 3

Hardness and ductility of sintered powders

| Powder | Vickers hardness (HV10) | Impact resistance ($J/cm^2$) |
|---|---|---|
| Umicore EF | 280 | 87 to 123 |
| Cobalite ® 601 | 250 | 74 |
| Cobalite ® 801 | 221 | 77 |
| Powder 1 | 327 | 54 |
| Powder 2 | 240 | 48 |
| Powder 3 | 322 | 33 |
| Powder 4 | 221 | 55 |

The results show that the Co containing Powders 1 and 3 are harder than the reference powders. This increased hardness is obtained without yielding borderline ductility values. The Co and Ni free Powders 2 and 4 prove to be an interesting substitute for the reference powders, with the advantage of containing no metals that are suspected to be damaging the environment.

FIG. 1 illustrates the full potential of the invention. It represents the hardness of segments, sintered from pre-alloyed powders, as a function of the Co to Fe ratio, Ni being absent. All powders used for making this figure were produced according to the methods of the invention and contained between 18 and 20% of Cu. In the case of the pre-alloyed powders according to the invention, the Mo or W level was 5% and the Sn level was 1.8 to 2%. The powders were all sintered at 750, 800 and 850° C. From these 3 results for each powder the optimum temperature was chosen as the temperature with the highest hardness, provided that the ductility was at least 20 $J/cm^2$. This optimum hardness was plotted in FIG. 1. The conclusion is that segments sintered from powders, prepared according to the invention, show a higher hardness than segments sintered from powders, prepared according to the same methods but without addition of Sn, Ni, W or Mo. Alternatively stated, segments sintered from powders prepared according to the invention and showing the same hardness as segments sintered from powders prepared according to the prior art, contain less Co.

EXAMPLE 7

Properties of Sintered ODS Containing Powders

In this example, ODS containing powders according to the invention, such as Powder 4, are compared to a powder without ODS, also according to the invention.

Bar-shaped compacts with dimensions of 55×10×10 $mm^3$ were sintered at 35 MPa for 3 minutes at a temperature of 800° C. in graphite moulds. The Vickers hardness, impact resistance and density of the sintered pieces were measured. The results of the measurements are given in the Table 4.

TABLE 4

Influence of ODS

| Powder | Density (%) | Hardness (HV10) | Impact resistance ($J/cm^2$) |
|---|---|---|---|
| $Fe_{75.2}W_{2.5}Cu_{20.5}Sn_{1.8}$ | 98.8 | 211 | 60 |
| $Fe_{75}W_{2.5}Cu_{20.45}Sn_{1.8}(Y_2O_3)_{0.25}$ (*) | 98.3 | 221 | 55 |
| $Fe_{74.8}W_{2.5}Cu_{20.4}Sn_{1.8}(Y_2O_3)_{0.5}$ | 99.3 | 227 | 42 |

(*) Powder 4

The results show that the addition of an oxide strengthener allows for a better hardness, without any sacrifice on sinterability and with only a limited impact on ductility.

EXAMPLE 8

Influence of Sn and W

This example illustrates the influence of Sn addition on the sinterability of the powders and on the ductility of the obtained segments. Diamond tool manufacturers often add W or Mo to increase the strength and hardness of their segments. To illustrate this, pre-alloyed powder were made based on Cobalite® 601, but with partial substitution of Fe by Mo and W. The segments were sintered at 35 MPa for 3 minutes at a temperature of respectively 850° C. and 900° C. in graphite moulds. The results are summarised in Table 5.

TABLE 5

Density and hardness sintered powders containing no Sn

| Powder | Density (%) at sintering temperature 850° C. | 900° C. | Hardness (HV10) |
|---|---|---|---|
| $Fe_{67.4}Co_{10}Cu_{20}Mo_{2.6}$ | 89.7 | 93.0 | 266 |
| $Fe_{68.75}Co_{10}Cu_{20}W_{1.25}$ | 94.1 | 96.1 | 229 |

The densities obtained for powders containing Mo or W, but no Sn, are too low to yield good segments.

On the other hand, if the weight fraction of Sn is too high, this will result in very brittle segments, caused by the formation of the δ-phase. This is shown in Table 6. This table summarises the values for impact resistance for 3 samples containing 5% of Sn and having a composition similar to Powders 1 to 3. All samples have a Sn/Cu ratio of about 0.25, that is clearly outside the scope of the invention. The segments were sintered at 35 MPa for 3 minutes at a temperature of 800° C. in graphite moulds.

TABLE 6

Impact resistance of sintered powders with excessive Sn

| Powder | Impact resistance ($J/cm^2$) |
|---|---|
| $Fe_{63}Co_9Mo_5Cu_{18}Sn_5$ | 0.6 |
| $Fe_{70}Mo_5Cu_{20}Sn_5$ | 1.7 |
| $Fe_{63}Co_9W_5Cu_{18}Sn_5$ | 0.7 |

Lowering the Sn contents restores the ductility, provided that one can prevent the diffusion of Sn into the Fe lattice, as shown in the next table. The powders were prepared according to the invention and segments were sintered by pressing for 3 minutes at a temperature of 800° C. in graphite moulds, under a pressure of 35 MPa.

TABLE 7

Mechanical properties of sintered powders with Sn and W

| Powder | Density (%) | Hardness (HV10) | Impact resistance ($J/cm^2$) |
|---|---|---|---|
| $Fe_{77}Cu_{21.1}Sn_{1.9}$ (*) | 99.7 | 195 | 5.8 |
| $Fe_{75.1}W_{2.5}Cu_{20.5}Sn_{1.9}$ | 100 | 230 | 70 |
| $Fe_{73.2}W_5Cu_{20}Sn_{1.8}$ | 99.7 | 235 | 93 |
| $Fe_{71.2}W_{7.5}Cu_{19.5}Sn_{1.8}$ | 100 | 248 | 33 |
| $Fe_{69.3}W_{10}Cu_{18.9}Sn_{1.8}$ | 97.0 | 239 | 20 |

(*) Powder not according to the invention

The results prove that the addition of a reinforcing element to the Fe phase is necessary to maintain ductility. These data also clearly show that the limit for the addition of W is around 10%. For higher values, the ductility is too low.

EXAMPLE 9

Preparation of a Fe—Co—W—Cu—Sn—(WC) Alloy

A precursor was prepared according to the method of Example 3 but with a different composition. 20 g of this precursor was heated in the presence of a mixture of gasses, using a flow rate of 100 l/h. The mixture consisted of 17% CO and 87% $H_2$. The heating programme was the following:

50° C./min to 300° C.;

2.5° C./min to 770° C.

Then, the temperature was maintained constant for 2 hrs, after which the atmosphere was changed to 100% $H_2$, while keeping the temperature of 770° C. constant for another hour. Then, the atmosphere was changed to 100% $N_2$ and the furnace was switched off.

A metallic powder was obtained consisting of 20% of Cu, 58.5% of Fe, 1.5% of Sn, 10% of W, 10% of Co (these percentages are on the metallic fraction only) and 0.88% of oxygen. X-ray diffraction showed the presence of peaks corresponding to WC, indicating the partly conversion of W to WC. The powder particles had an average diameter of 2.0 μm, measured with the FSSS. This powder falls within the compositional range of the invention.

EXAMPLE 10

Further Compositions According to the Invention

Using methods analogous to Examples 1 to 4, a number of pre-alloyed powders were produced in the system Fe—Cu—Co—W—Mo—Sn—ODS. Table 8 gives an overview of those powders that, after sintering at a temperature at or below 850° C., have a Charpy impact resistance of more than about 20 $J/cm^2$. All these compositions have a hardness of 200 HV10 or more. All these compositions fall within the compositional range of the invention.

EXAMPLE 11

Compositions not According to the Invention

Using methods analogous to Examples 1 to 4, a number of pre-alloyed powders were produced in the system Fe—Cu—Co—W—Mo—Sn—ODS. Table 9 gives an overview of those powders that, after sintering at a temperature at or below 850° C., have a Charpy impact resistance of less than about 20 $J/cm^2$. These powders are not covered by the present invention.

TABLE 8

Further compositions according to the invention (without Ni)

| Powder n° | a % Fe | b % Co | d % Mo | e % W | f % Cu | g % Sn | h % ODS | f/g Cu/Sn | [a/(b + c + 2d + 2e)] − 4 h |
|---|---|---|---|---|---|---|---|---|---|
| 5 | 70.2 | 5 | 5 | | 18 | 1.8 | | 10.0 | 4.7 |
| 6 | 72 | 10 | | 5 | 12 | 1 | | 12.0 | 3.6 |
| 7 | 58 | 10 | | 10 | 20 | 2 | | 10.0 | 1.9 |
| 8 | 58.5 | 10 | | 10 | 20 | 1.5 | | 13.3 | 2 |

TABLE 8-continued

Further compositions according to the invention (without Ni)

| Powder n° | a % Fe | b % Co | d % Mo | e % W | f % Cu | g % Sn | h % ODS | f/g Cu/Sn | [a/(b + c + 2d + 2e)] − 4 h |
|---|---|---|---|---|---|---|---|---|---|
| 9 | 59 | 10 | | 10 | 20 | 1 | | 20.0 | 2 |
| 10 | 57.5 | 10 | | 6 | 24 | 2.5 | | 9.6 | 2.6 |
| 11 | 58.5 | 10 | | 2 | 26 | 3 | 0.5 | 8.7 | 2.2 |
| 12 | 60 | 10 | | | 26.5 | 3 | 0.5 | 8.8 | 4.0 |
| 13 | 61.9 | 10.5 | | 5 | 21 | 1.6 | | 13.1 | 3 |
| 14 | 65.3 | 11 | | | 22 | 1.7 | | 12.9 | 5.9 |
| 15 | 60.2 | 15 | 5 | | 18 | 1.8 | | 10.0 | 2.4 |
| 16 | 59.2 | 15 | | 4 | 20 | 1.8 | | 11.1 | 2.6 |
| 17 | 58.2 | 15 | | 5 | 20 | 1.8 | | 11.1 | 2.3 |
| 18 | 57.2 | 15 | | 6 | 20 | 1.8 | | 11.1 | 2.1 |
| 19 | 55.7 | 15 | | 7.5 | 20 | 1.8 | | 11.1 | 1.9 |
| 20 | 54.2 | 15 | | 9 | 20 | 1.8 | | 11.1 | 1.6 |
| 21 | 56 | 18 | | 6 | 18 | 2 | | 9.0 | 1.9 |
| 22 | 59 | 18 | 3 | | 18 | 2 | | 9.0 | 2.5 |
| 23 | 57.7 | 20 | 2.5 | | 18 | 1.8 | | 10.0 | 2.3 |
| 24 | 55.2 | 20 | 5 | | 18 | 1.8 | | 10.0 | 1.8 |
| 25 | 52.7 | 20 | 7.5 | | 18 | 1.8 | | 10.0 | 1.5 |
| 26 | 53.5 | 20 | 5 | 0 | 20 | 1.5 | | 13.3 | 1.8 |
| 27 | 53.2 | 20 | | 5 | 20 | 1.8 | | 11.1 | 1.8 |
| 28 | 53.5 | 20 | | 5 | 20 | 1.5 | | 13.3 | 1.8 |
| 29 | 54.8 | 20.1 | | 1.5 | 21.5 | 2.1 | | 10.2 | 2.4 |
| 30 | 56 | 21 | | | 21 | 2 | | 10.5 | 2.7 |
| 31 | 56 | 21 | | | 21.1 | 1.9 | | 11.1 | 2.7 |
| 32 | 52.7 | 25 | 2.5 | | 18 | 1.8 | | 10.0 | 1.8 |
| 33 | 84.75 | | 4.5 | | 10 | 0.75 | | 13.3 | 9.4 |
| 34 | 79.3 | | | 5.3 | 14 | 1.4 | | 10.0 | 7.5 |
| 35 | 77.5 | | | 7.1 | 14 | 1.4 | | 10.0 | 5.5 |
| 36 | 76.2 | | | 5.1 | 17 | 1.7 | | 10.0 | 7.5 |
| 37 | 74.5 | | | 6.8 | 17 | 1.7 | | 10.0 | 5.5 |
| 38 | 75.2 | | 5 | | 18 | 1.8 | | 10.0 | 7.5 |
| 39 | 69.4 | | | 10 | 18.9 | 1.7 | | 11.1 | 3.5 |
| 40 | 75.1 | | | 2.5 | 19.9 | 2 | 0.5 | 10.0 | 13 |
| 41 | 74.5 | | 5 | | 20 | 0.5 | | 40.0 | 7.5 |
| 42 | 74 | | 5 | | 20 | 1 | | 20.0 | 7.4 |
| 43 | 74.6 | | | 3.9 | 20 | 1.5 | | 13.3 | 9.6 |
| 44 | 73.5 | | | 5 | 20 | 1.5 | | 13.3 | 7.4 |
| 45 | 76 | | 2.5 | | 20 | 1.5 | | 13.3 | 15.2 |
| 46 | 74.6 | | 3.9 | | 20 | 1.5 | | 13.3 | 9.6 |
| 47 | 73.5 | | 5 | | 20 | 1.5 | | 13.3 | 7.4 |
| 48 | 73.2 | | | 5 | 20 | 1.8 | | 11.1 | 7.3 |
| 49 | 73.1 | | | 4.9 | 20 | 2 | | 10.0 | 7.5 |
| 50 | 71.5 | | | 6.5 | 20 | 2 | | 10.0 | 5.5 |
| 51 | 76.64 | | | 1.17 | 20.3 | 1.64 | 0.25 | 12.4 | 31.8 |
| 52 | 74.8 | | | 2.5 | 20.4 | 1.8 | 0.5 | 11.3 | 13 |
| 53 | 75 | | | 2.5 | 20.45 | 1.8 | 0.25 | 11.4 | 14 |
| 54 | 75.2 | | | 2.5 | 20.5 | 1.8 | | 11.4 | 15 |
| 55 | 70 | | | 4.7 | 23 | 2.3 | | 10.0 | 7.4 |
| 56 | 68.5 | | | 6.2 | 23 | 2.3 | | 10.0 | 5.5 |
| 57 | 66.9 | | | 4.5 | 26 | 2.6 | | 10.0 | 7.4 |
| 58 | 65.4 | | | 6 | 26 | 2.6 | | 10.0 | 5.5 |
| 59 | 68.5 | | | 2 | 26 | 3 | 0.5 | 8.7 | 15.1 |
| 60 | 68 | | | 2 | 26.5 | 3 | 0.5 | 8.8 | 15 |
| 61 | 64.35 | | 3.4 | | 30 | 2.25 | | 13.3 | 9.5 |

TABLE 9

Compositions not according to the invention

| Powder n° | a % Fe | b % Co | d % Mo | e % W | f % Cu | g % Sn | h % ODS | f/g | [a/(b + c + 2d + 2e)] − 4 h |
|---|---|---|---|---|---|---|---|---|---|
| 62 | 59 | 9 | | 10 | 17 | 5 | | 3.4 (*) | 2 |
| 63 | 59 | 9 | 10 | | 17 | 5 | | 3.4 | 2 |
| 64 | 63 | 9 | | 5 | 18 | 5 | | 3.6 | 3.3 |
| 65 | 63 | 9 | 5 | | 18 | 5 | | 3.6 | 3.3 |
| 66 | 56 | 9.5 | | 6 | 25 | 3 | 0.5 | 8.3 | 0.6 |
| 67 | 63.2 | 10 | | 4.5 | 20 | 1.5 | 0.8 | 13.3 | 0.1 |

TABLE 9-continued

| Compositions not according to the invention | | | | | | | | | |
|---|---|---|---|---|---|---|---|---|---|
| Powder n° | a % Fe | b % Co | d % Mo | e % W | f % Cu | g % Sn | h % ODS | f/g | [a/(b + c + 2d + 2e)] − 4 h |
| 68 | 63.5 | 10 | | 4.5 | 20 | 1.5 | 0.5 | 13.3 | 1.3 |
| 69 | 58.5 | 10 | 10 | | 20 | 1.5 | | 13.3 | 2 |
| 70 | 53.5 | 20 | | 4.5 | 20 | 1.5 | 0.5 | 13.3 | −0.2 |
| 71 | 50.2 | 25 | 5 | | 18 | 1.8 | | 10.0 | 1.4 |
| 72 | 70 | | 5 | | 20 | 5 | | 4.0 | 7 |
| 73 | 68.5 | | 10 | | 20 | 1.5 | | 13.3 | 4.4 |

(*) Underlined data are outside specifications

EXAMPLE 12

Effect of Mechanical Alloying on Sinter Reactivity

In Tables 10a to 10e, the sinter reactivity of fine pre-alloyed powders produced by precursor reduction is compared to that of coarse powders produced by mechanical alloying. The powders prepared by precursor reduction were manufactured according to the process detailed in Examples 1 to 3. The mechanically alloyed powders were made by treating a simple blend of individual metal powders at 1000 rpm for 3 hours in a Simoloyer™ CM8 high intensity ball mill made by ZOZ GmbH in Germany. Both types of powders were sintered in a hot- or press for 3 minutes at the specified temperatures under a pressure of 350 bar, and the density of the obtained compact was measured.

TABLE 10a

| Sinter reactivity of $Fe_{53.5}Co_{20}Mo_5Cu_{20}Sn_{1.5}$ powders according to the invention | | |
|---|---|---|
| Process | Precursor reduction | Mechanical alloying |
| Sympatec d50 (μm) | 7.3 | 51 |
| Oxygen (%) | 0.16 | 0.45 |
| Sintering (° C.) | Relative density (%) | Relative density (%) |
| 725 | 91 | 94 |
| 750 | 95 | 97 |
| 775 | 98 | 98 |
| 800 | 99 | 98 |

TABLE 10b

| Sinter reactivity of $Fe_{73.5}Mo_5Cu_{20}Sn_{1.5}$ powders according to the invention | | |
|---|---|---|
| Process | Precursor reduction | Mechanical alloying |
| Sympatec d50 (μm) | 16.2 | 52 |
| Oxygen (%) | 0.44 | 0.41 |
| Sintering (° C.) | Relative density (%) | Relative density (%) |
| 750 | <80 | 99 |
| 800 | 85 | 99 |
| 850 | 99 | 99 |
| 900 | 99 | 99 |

TABLE 10c

| Sinter reactivity of $Fe_{74.5}Mo_4Cu_{20}Sn_{1.5}$ powders according to the invention | | |
|---|---|---|
| Process | Precursor reduction | Mechanical alloying |
| Sympatec d50 (μm) | 18.3 | 28 |
| Oxygen (%) | 0.41 | 0.39 |
| Sintering (° C.) | Relative density (%) | Relative density (%) |
| 750 | 78 | 96 |
| 800 | 84 | 98 |
| 850 | 96 | 99 |
| 900 | 97 | 99 |

TABLE 10d

| Sinter reactivity of $Fe_{53.2}Co_{20}W_5Cu_{20}Sn_{1.8}$ powders according to the invention | | |
|---|---|---|
| Process | Precursor reduction | Mechanical alloying |
| Sympatec d50 (μm) | 9.8 | 55.8 |
| Oxygen (%) | 0.28 | 0.50 |
| Sintering (° C.) | Relative density (%) | Relative density (%) |
| 650 | 81 | 95 |
| 675 | 89 | 97 |
| 700 | 90 | 97 |
| 725 | 98 | 98 |

TABLE 10e

| Sinter reactivity of $Fe_{58.5}Co_{10}W_{10}Cu_{20}Sn_{1.5}$ powders according to the invention | | |
|---|---|---|
| Process | Precursor reduction | Mechanical alloying |
| Sympatec d50 (μm) | 9.4 | 54 |
| Oxygen (%) | 0.30 | 0.32 |
| Sintering (° C.) | Relative density (%) | Relative density (%) |
| 650 | 87 | 91 |
| 675 | 91 | 94 |
| 700 | 95 | 95 |
| 725 | 98 | 98 |

From tables 10a to 10e, it can be seen that mechanically alloyed powders can be effectively sintered at temperatures of about 100° C. below the temperatures needed for the powders obtained by precursor reduction. This is the case even though the powders produced by mechanical alloying are considerably coarser than the powders produced by precursor reduction.

The invention claimed is:

1. Pre-alloyed powder comprising a composition of formula $Fe_aCo_bNi_cMo_dW_eCu_fSn_g(DS)_h$, a, b, c, d, e, f, g and h representing the percentages by weight of the components, DS being either one of an oxide of one or more metals from the group consisting of Mg, Mn, Ca, Cr, Al, Th, Y, Na, Tj and V, a carbide of one or more metals from the group consisting of Fe, W, Mo, Zr and Ti, or a mixture of said oxide and of said carbide, wherein $a+b+c+d+e+f+g+h=100$, $d\leqq 8$, $e\leqq 10$, $h\leqq 2$, $5\leqq f+g\leqq 45$, $6.4\leqq f/g\leqq 25$ and $1.5\leqq [a/(b+c+2d+2e)]-4h\leqq 33$, the powder further having a loss of mass by reduction in hydrogen not exceeding 2%, as measured according to the standard ISO 4491-2:1989.

2. Pre-alloyed powder according to claim 1, manufactured by mechanical alloying, and having a mean particle size (d50) of less than 500 μm.

3. Pre-alloyed powder according to claim 1, wherein the powder has a particle size not exceeding 20 μm, as measured with the Fisher Sub Sieve Sizer.

4. Pre-alloyed powder according to claim 1, wherein either one of b=0, c=0, or b+c=0.

5. Pre-alloyed powder according to claim 3, wherein the powder has a particle size not exceeding 15 μm, as measured with the Fisher Sub Sieve Sizer.

6. Pre-alloyed powder according to claim 1, wherein the powder has a specific surface of at least 0.1 $m^2/g$, as measured according to BET.

7. Pre-alloyed powder according to claim 1, wherein the powder has a loss of mass by reduction in hydrogen not exceeding 1%, as measured according to the standard ISO 4491-2:1989.

8. Process of preparing a pre-alloyed powder comprising a composition of formula $Fe_aCo_bNi_cMo_dW_eCu_fSn_g(DS)_h$, a, b, c, d, e, f, g and h representing the percentages by weight of the components, DS being either one of an oxide of one or more metals from the group consisting at Mg, Mn, Ca, Cr, Al, Th, Y, Na, Ti and V, a carbide of one or more metals from the group consisting of Fe, W, Mo, Zr and Ti, or a mixture of said oxide and of said carbide, wherein $a+b+c+d+e+f+g+h=100$, $d\leqq 8$, $e\leqq 10$, $h\leqq 2$, $5\leqq f+g\leqq 45$, $6.4\leqq f/g\leqq 25$ and $1.5\leqq [a/(b+c+2d+2e)]-4h\leqq 33$, the powder further having a loss of mass by reduction in hydrogen not exceeding 2%, as measured according to the standard ISO 4491-2:1989, the process comprising the steps of:

providing for quantities of the components of the composition as elementary, pre-alloyed or alloyed powders, and subjecting said quantities to a mechanical alloying step.

9. Pre-alloyed powder according to claim 3, wherein the powder has a particle size not exceeding 10 μm, as measured with the Fisher Sub Sieve Sizer.

10. Pre-alloyed powder according to claim 1, wherein the powder has a loss of mass by reduction in hydrogen not exceeding 0.5%, as measured according tote standard ISO 4491-2:1989.

11. A process of manufacturing a diamond tool, comprising:

mixing diamond with a bond powder, and hot sintering or hot pressing the mixture, wherein the bond powder comprises a pre-alloyed powder comprising a composition of formula $Fe_aCo_bNi_cMo_dW_eCu_fSn_g(DS)_h$, a, b, c, d, e, f, g and h representing the percentages by weight of the components, DS being either one of an oxide of one or more metals from the group consisting of Mg, Mn, Ca, Cr, Al, Th, Y, Na, Ti and V, a carbide of one or more metals from the group consisting of Fe, W, Mo, Zr and Ti, or a mixture of said oxide and of said carbide, wherein $a+b+c+d+e+f+g+h=100$, $d\leqq 8$, $e\leqq 10$, $h\leqq 2$, $5\leqq f+g\leqq 45$, $6.4\leqq f/g\leqq 25$ and $1.5\leqq [a/(b+c+2d+2e)]-4h\leqq 33$, the powder further having a loss of mass by reduction in hydrogen not exceeding 2%, as measured according to the standard ISO 4491-2:1989.

12. The pre-alloyed powder according to claim 1, wherein the powder further comprises unavoidable impurities.

13. A process of manufacturing a metal object, comprising:

forming the metal object using a pre-alloyed powder comprising a composition of formula $Fe_aCo_bNi_cMo_dW_eCu_fSn_g(DS)_h$, a, b, c, d, e, f, g and h representing the percentages by weight of the components, DS being either one of an oxide of one or more metals from the group consisting of Mg, Mn, Ca, Cr, Al, Th, Y, Na, Ti and V, a carbide of one or more metals from the group consisting of Fe, W, Mo, Zr and Ti, or a mixture of said oxide and of said carbide, wherein $a+b+c+d+e+f+g+h=100$, $d\leqq 8$, $e\leqq 10$, $h\leqq 2$, $5\leqq f+g\leqq 45$, $6.4\leqq f/g\leqq 25$ and $1.5\leqq [a/(b+c+2d+2e)]-4h\leqq 33$, the powder further having a loss or mass by reduction in hydrogen not exceeding 2%, as measured according to the standard ISO 4491-2:1989.

* * * * *

UNITED STATES PATENT AND TRADEMARK OFFICE

CERTIFICATE OF CORRECTION

PATENT NO. : 7,077,883 B2
APPLICATION NO. : 10/952428
DATED : July 18, 2006
INVENTOR(S) : Bert-Jan Kamphuis and Janneck Peersman It is certified that error appears in the above-identified patent and that said Letters Patent is hereby corrected as shown below:

IN THE CLAIMS:

Column 19, line 12, “Tj” should read --Ti--; line 47, “at” should read --of--.

Column 20, line 11, “tote” should read --to the--.

Signed and Sealed this

Twelfth Day of December, 2006

JON W. DUDAS
*Director of the United States Patent and Trademark Office*